US009359985B2

(12) United States Patent
Brown et al.

(10) Patent No.: US 9,359,985 B2
(45) Date of Patent: Jun. 7, 2016

(54) FLUID INJECTOR ACTUATOR WITH RESILIENT ARMATURE OVERTRAVEL FEATURE

(71) Applicant: Caterpillar Inc., Peoria, IL (US)

(72) Inventors: Cory Brown, Peoria, IL (US); Adam Stecklein, Peroria, IL (US); Adrienne Brasche, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/477,049

(22) Filed: Sep. 4, 2014

(65) Prior Publication Data

US 2016/0069312 A1 Mar. 10, 2016

(51) Int. Cl.

| | |
|---|---|
| ***B05B 1/30*** | (2006.01) |
| ***F02M 51/06*** | (2006.01) |
| ***H01F 7/16*** | (2006.01) |

(52) U.S. Cl.

CPC ..... *F02M 51/0671* (2013.01); *H01F 7/1607* (2013.01)

(58) Field of Classification Search

CPC ... F02M 43/04; F02M 45/086; F02M 47/027; F02M 63/029; F02D 19/0684; F02D 19/0694; F23R 3/283; F23R 11/36; F23R 3/343

USPC ..... 239/585.1, 585.3, 585.4, 585.5; 29/890.124, 890.127

See application file for complete search history.

(56) References Cited

U.S. PATENT DOCUMENTS

| | | | | |
|---|---|---|---|---|
| 5,619,963 | A * | 4/1997 | Faletti | F01L 13/06 123/321 |
| 6,109,541 | A * | 8/2000 | Beatty | F02M 57/025 239/585.1 |
| 6,305,355 | B1 | 10/2001 | Hoffmann et al. | |
| 6,688,579 | B2 | 2/2004 | Grytz | |
| 6,997,432 | B2 | 2/2006 | Rapp | |
| 8,459,577 | B2 | 6/2013 | Manubolu et al. | |
| 8,689,772 | B2 | 4/2014 | Hefler et al. | |
| 2003/0111558 | A1 * | 6/2003 | Ricco | F02M 47/027 239/533.2 |
| 2003/0141475 | A1 | 7/2003 | Ruthardt et al. | |
| 2008/0251612 | A1 * | 10/2008 | Rodriguez-Amaya | F02M 57/023 239/585.1 |

FOREIGN PATENT DOCUMENTS

EP 2218901 B1 8/2010

* cited by examiner

*Primary Examiner* — Davis Hwu

(74) *Attorney, Agent, or Firm* — Baker & Hostetler LLP

(57) ABSTRACT

An actuator for a valve assembly includes a body having an internal surface defining a bore therein, the internal surface including a first body shoulder at least partly facing a longitudinal direction defined along a longitudinal axis of the bore; a first armature disposed within the bore, the first armature being configured to generate a force in response to a first electromagnetic field acting thereon; a first stem operatively coupled to the first armature and a first valve of the valve assembly; a first pair of shoulders disposed on the first stem, the first pair of shoulders at least partly facing one another and defining a first stem circumferential groove therebetween; and a first valve travel spacer disposed about the first stem circumferential groove, and disposed in interference with the first body shoulder along the longitudinal direction.

19 Claims, 5 Drawing Sheets

FLUID INJECTOR ACTUATOR WITH RESILIENT ARMATURE OVERTRAVEL FEATURE

TECHNICAL FIELD

This patent disclosure relates generally to fluid injectors and, more particularly, to fuel injector actuators having a resilient armature overtravel feature.

BACKGROUND

Reciprocating internal combustion (IC) engines are known for converting chemical energy stored in a fuel supply into mechanical shaft power. IC engines may use one or more fuel injectors to inject a quantity of combustible fuel into a variable volume defined by a piston translating within an engine cylinder. In turn, the injected fuel mixes with an oxidizer and burns within the variable volume to perform work on the piston. Fuel injectors may be used to inject fuel directly into a variable volume of an IC engine, inject fuel into an oxidizer flow upstream of a variable volume of an IC engine, or combinations thereof.

Solenoids have been used to electrically actuate fluid injectors, such as IC engine fuel injectors, whereby a current flowing through a stator coil creates a magnetic field that imparts a force on an armature. In turn, armature movement induced by the magnetic field may act to initiate a fuel injection event, end a fuel injection event, or tailor a flow rate of an ongoing fuel injection event. The effective stroke distance of the armature may be very small, and therefore, injector performance may be sensitive to tolerance stack-up among injector components, and may be sensitive to small armature movements caused by dynamic overtravel, for example.

U.S. Pat. No. 6,688,579 (the '579 patent), entitled "Solenoid Valve for Controlling a Fuel Injector of an Internal Combustion Engine," purports to address the problems of armature bounce upon de-energizing the solenoid, and sensitivity to the precise setting of the maximum slide path which is to be available to an armature plate on an armature pin. The '579 patent describes a two-part armature including an armature plate decoupled from an armature pin. Further according to the '579 patent, an overtravel stop is arranged between the armature plate and a sliding sleeve, such that the overtravel stop delimits the maximum possible movement path of the armature plate on the armature pin, which is adjustable by an actuator. The actuator of the '579 patent is implemented as a screw element provided with an internal thread that is screwed onto an external thread of the armature plate, such that relative rotational motion between the actuator and the armature plate varies the maximum possible movement path of the armature plate on the armature pin.

However, the screw-type adjustment of maximum axial movement between the armature plate and the armature pin in the '579 patent may pose repeatability and reproducibility challenges upon assembly, in addition to challenges regarding hardware cost, complexity, special tooling, and access to adjust the actuator upon assembly. Accordingly, improved fluid injector actuators are desired to address the aforementioned problems and/or other problems in the art.

SUMMARY

According to an aspect of the disclosure, an actuator for a valve assembly includes a body having an internal surface defining a bore therein, the internal surface including a first body shoulder at least partly facing a longitudinal direction defined along a longitudinal axis of the bore; a first armature disposed within the bore, the first armature being configured to generate a force in response to a first electromagnetic field acting thereon; a first stem operatively coupled to the first armature and a first valve of the valve assembly; a first pair of shoulders disposed on the first stem, the first pair of shoulders at least partly facing one another and defining a first stem circumferential groove therebetween; and a first valve travel spacer disposed about the first stem circumferential groove, and disposed in interference with the first body shoulder along the longitudinal direction.

According to another aspect of the disclosure, a fuel injector includes a valve assembly; a body having an internal surface defining a bore therein, the internal surface including a first body shoulder at least partly facing a longitudinal direction defined along a longitudinal axis of the bore; a first armature disposed within the bore, the first armature being configured to generate a force in response to a first electromagnetic field acting thereon; a first stem operatively coupled to the first armature and a first valve of the valve assembly; a first pair of shoulders disposed on the first stem, the first pair of shoulders at least partly facing one another and defining a first stem circumferential groove therebetween; and a first valve travel spacer disposed about the first stem circumferential groove in interference with the first body shoulder along the longitudinal direction.

According to another aspect of the disclosure, a method for assembling an actuator for a valve includes inserting a distal end of a stem through a bore of an armature, inserting the distal end of the stem through a bore of an actuator body, and translating a valve travel spacer along a radial channel of the actuator body until the valve travel spacer engages a circumferential groove of the stem, thereby disposing the valve travel spacer between the distal end of the stem and the actuator body along a longitudinal axis of the stem.

DETAILED DESCRIPTION

Aspects of the disclosure will now be described in detail with reference to the drawings, wherein like reference numbers refer to like elements throughout, unless specified otherwise.

Figure 1:
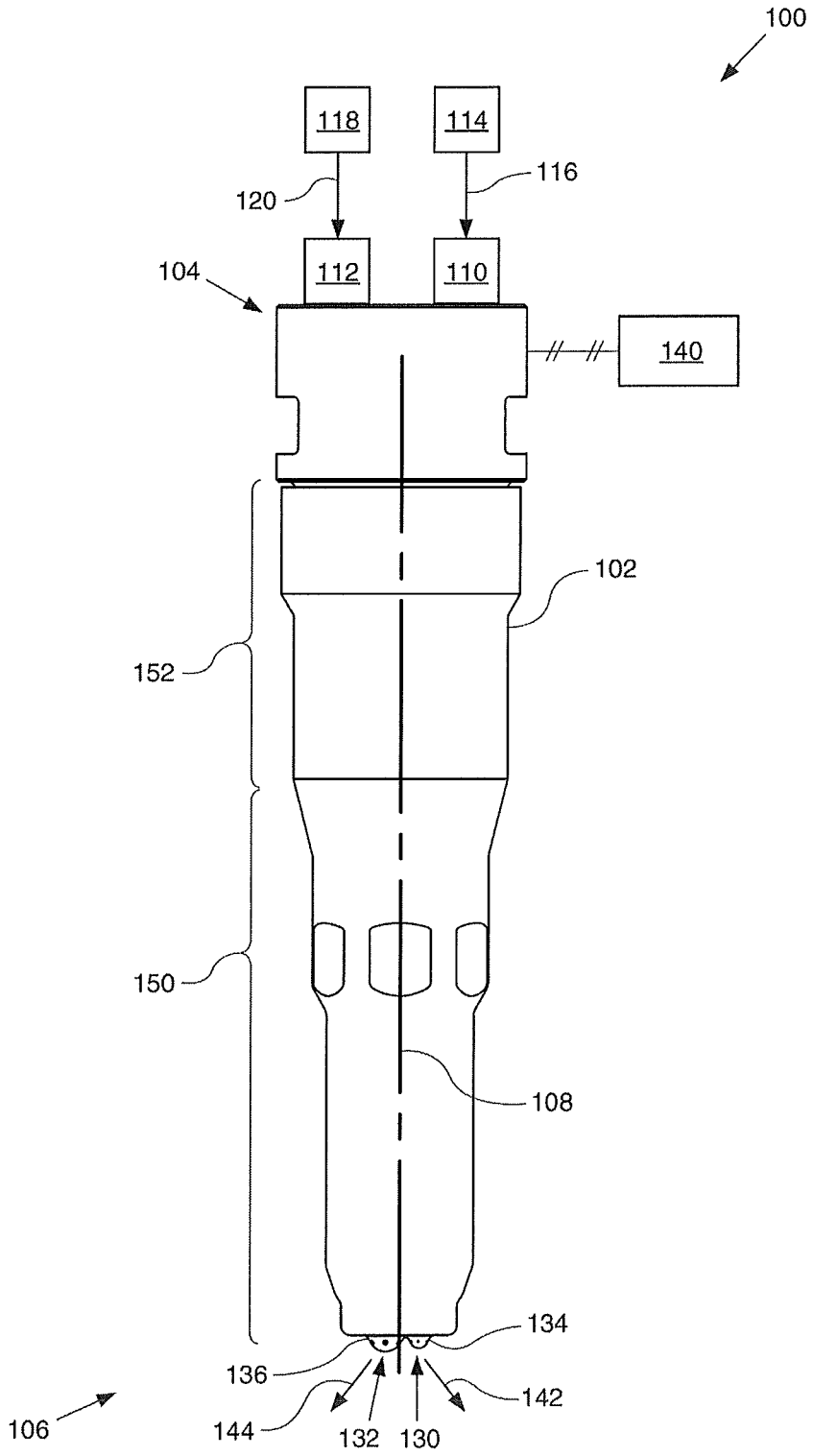
FIG. 1 is a front view schematic of a fluid injector, according to an aspect of the disclosure.

FIG. 1 shows a front schematic view of a fluid injector 100, according to an aspect of the disclosure. The fluid injector 100 includes a body 102 that extends from a proximal end 104 of the injector 100 to a distal end 106 of the injector 100. A longitudinal axis 108 may extend along a length of the injector 100 from the proximal end 104 to the distal end 106. According to an aspect of the disclosure, the fluid injector 100 is a fuel injector for delivering fuel to a variable volume within a reciprocating IC engine (not shown), such as a compression ignition engine or a spark ignition engine, or other reciprocating IC engine known in the art. However, it will be appreciated that aspects of the disclosure may be advantageously applied in other fluid injection contexts.

The injector 100 receives fluid at a first inlet port 110, a second inlet port 112, or both. The first inlet port 110 may be in fluid communication with a first fluid supply 114 via a first supply conduit 116, and the second inlet port 112 may be in fluid communication with a second fluid supply 118 via a second supply conduit 120. The first fluid supply 114 and the second fluid supply 118 may each include a fluid reservoir, a fluid pump, valves, instrumentation, controls, and any other features known in the art for providing a pressurized supply of fluid. As used herein, unless specified otherwise, the term "fluid" refers to gases, liquids, slurries, combinations thereof, or other similar materials that tend to flow in response to an applied shear stress.

The body 102 defines a first injection tip 130, a second injection tip 132, or both, disposed at the distal end 106 of the injector 100. The first injection tip 130 may define a first set of injection orifices 134 therethrough, and the second injection tip 132 may define a second set of injection orifices 136 therethrough.

The injector 100 is operatively coupled to a controller 140. The controller 140 may cause the injector 100 to selectively effect fluid communication between the first inlet port 110 and the first set of injection orifices 134, to selectively effect fluid communication between the second inlet port 112 and the second set of injection orifices 136, or both. Accordingly, the controller 140 may cause the injector 100 to selectively receive a first fluid from the first fluid supply 114 and direct the first fluid to the first injection tip 130 to form a fluid jet 142 through at least one orifice of the first set of injection orifices 134. Alternatively or additionally, the controller 140 may cause the injector 100 to selectively receive a second fluid from the second fluid supply 118 and direct the second fluid to the second injection tip 132 to form a fluid jet 144 through at least one orifice of the second set of injection orifices 136.

The controller 140 may embody a single microprocessor or multiple microprocessors that include means for receiving signals from sensors, other controllers, and the like, and transmitting signals to the injector 100. Numerous commercially available microprocessors may be configured to perform the functions of the controller 140. Further, it will be appreciated that the controller 140 may embody a general machine microprocessor, such as an electronic control unit for an engine or a machine embodying the injector 100. It will also be appreciated that the controller 140 may additionally include other components and may also perform other functions not described herein.

The injector 100 includes a nozzle portion 150 operatively coupled to an actuator portion 152. The nozzle portion 150 includes valve elements for selectively effecting or blocking fluid communication between one or more of the inlet ports 110, 112 and one or more of the sets of injection orifices 134, 136. The actuator portion 152 includes actuators configured to adjust the state of fluid communication between one or more of the inlet ports 110, 112 and one or more of the sets of injection orifices 134, 136 via the nozzle portion 150.

According to an aspect of the disclosure, the fluid injector 100 is a fuel injector for delivering fuel to a variable volume within a reciprocating IC engine (not shown). According to another aspect of the disclosure, the first fluid supply 114 delivers a combustible liquid fuel to the injector 100, and the first set of injection orifices 134 are sized an arranged on the first injection tip 130 to advantageously deliver one or more jets 142 of the liquid fuel to a variable volume within a reciprocating IC engine. Alternatively or additionally, the second fluid supply 118 delivers a combustible gaseous fuel to the injector 100, and the second set of injection orifices 136 are sized and arranged on the second injection tip 132 to advantageously deliver one or more jets 144 of the gaseous fuel to the variable volume within the reciprocating IC engine.

The liquid fuel supplied by the first fluid supply 114 may include distillate diesel, biodiesel, dimethyl ether, gasoline, ethyl alcohol, liquid-phase natural gas, liquid-phase propane, combinations thereof, or any other combustible liquid known in the art. The gaseous fuel supplied by the second fluid supply 118 may include natural gas, propane, ethylene, butane, hydrogen, combinations thereof, or any other combustible gas known in the art. Alternatively, it will be appreciated that both the first fluid supply 114 and the second fluid supply 118 may deliver the same or different combustible liquid fuels, or the same or different combustible gaseous fuels, to the injector 100.

Figure 2:
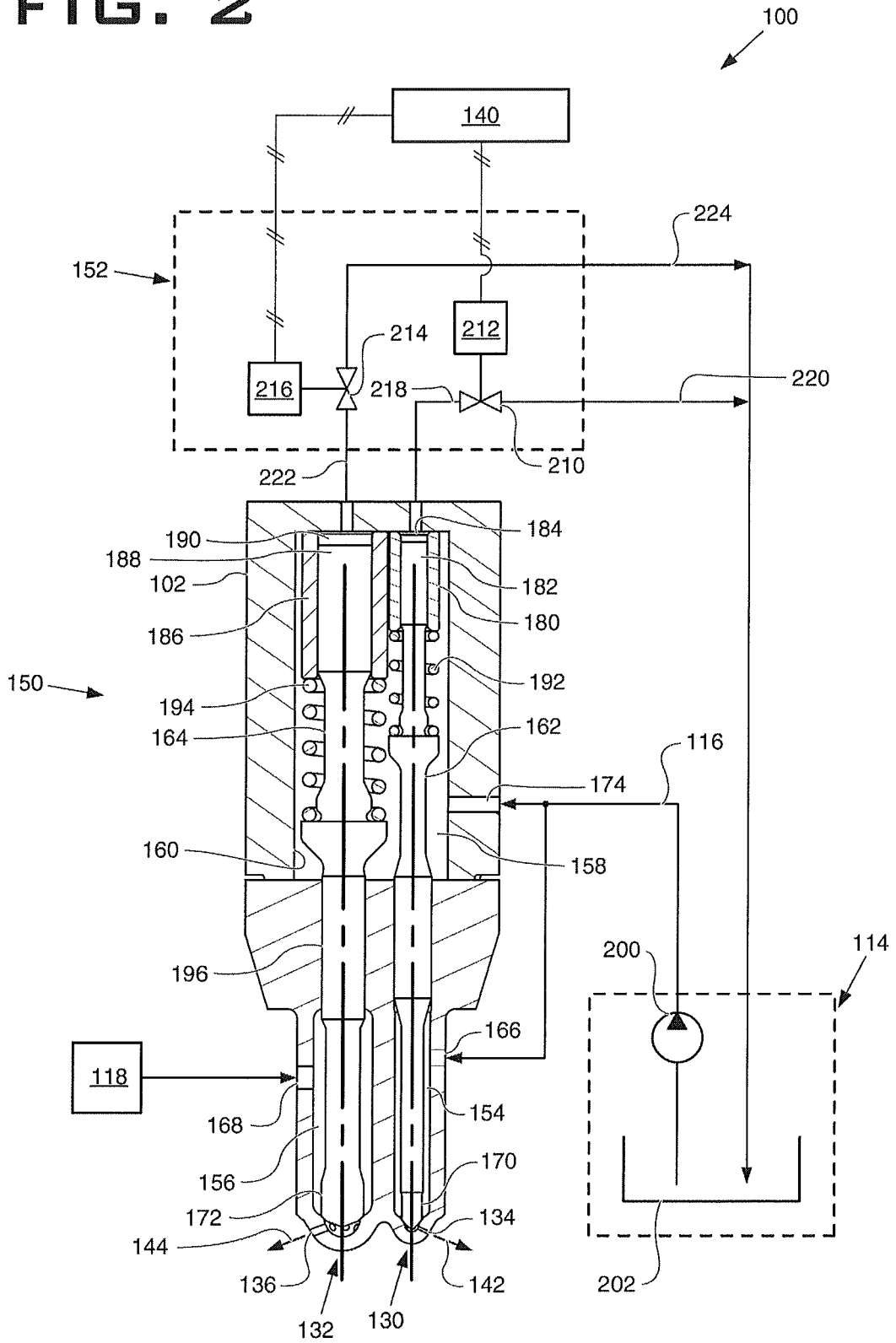
FIG. 2 is a front cross sectional schematic view of a nozzle portion of a fluid injector, according to an aspect of the disclosure.

FIG. 2 shows a front cross sectional schematic view of a nozzle portion 150 of a fluid injector 100, according to an aspect of the disclosure. The body 102 has an internal surface 160 defining a first injection chamber 154, a second injection chamber 156, and a check spring chamber 158. The injector 100 may include a first check needle 162 disposed in the first injection chamber 154 and a second check needle 164 disposed in the second injection chamber 156. The first injection chamber 154 may be in fluid communication with the first fluid supply 114 via a first injection chamber port 166, and the second injection chamber 156 may be in fluid communication with the second fluid supply 118 via a second injection chamber port 168. Sealing contact between a distal end 170 of the first check needle 162 and the internal surface 160 of the injector 100 may block fluid communication between the first injection chamber 154 and the first set of injection orifices 134, and sealing contact between a distal end 172 of the second check needle 164 and the internal surface 160 of the injector 100 may block fluid communication between the second injection chamber 156 and the second set of injection orifices 136.

Although FIG. 2 schematically shows the first injection chamber port 166 and the second injection chamber port 168 disposed through a wall of the body 102, it will be appreciated that internal passages defined by the fuel injector 100 may provide the fluid communication between the first injection chamber port 166 and the first fluid supply 114 via the first inlet port 110 (see FIGS. 1 and 3), and may provide the fluid communication between the second injection chamber port 168 and the second fluid supply 118 via the second inlet port 112. For example, US Patent Publication No. 2013/0319373 describes internal passages within the body of a dual fuel injector to effect fluid communication between each of a liquid fuel supply and a gaseous fuel supply and various cavities of the dual fuel injector.

As shown in the aspect illustrated in FIG. 2, the first check needle 162 and the second check needle 164 are both disposed within the check spring chamber 158, which is in fluid communication with the first fluid supply 114 via a check spring chamber port 174. Although FIG. 2 schematically shows the check spring chamber port 174 disposed through a wall of the body 102, it will be appreciated that internal passages defined by the fuel injector 100 may provide fluid communication between the check spring chamber 158 and the first fluid supply 114 via the first inlet port 110 (see FIG. 1), for example as described in US Patent Publication No. 2013/0319373.

A first check sleeve 180 is disposed within the check spring chamber 158, and the first check needle 162 is disposed at least partly within the first check sleeve 180, such that the first check sleeve 180, a proximal end 182 of the first check needle 162, and the internal surface 160 of the body 102 define a first control chamber 184. A second check sleeve 186 is disposed within the check spring chamber 158, and the second check needle 164 is disposed at least partly within the second check sleeve 186, such that the second check sleeve 186, a proximal end 188 of the second check needle 164, and the internal surface 160 of the body 102 define a second control chamber 190.

A first check spring 192 bears on the first check needle 162 and the first check sleeve 180, thereby urging the distal end 170 of the first check needle 162 toward sealing engagement with the internal surface 160 of the body 102. A second check spring 194 bears on the second check needle 164 and the second check sleeve 186, thereby urging the distal end 172 of the second check needle 164 toward sealing engagement with the internal surface 160 of the body 102.

According to an aspect of the disclosure, the second check needle 164 bears on the internal surface 160 of the body 102 to effect a sliding seal 196 between the check spring chamber 158 and the second injection chamber 156 along the surface of the second check needle 164.

According to an aspect of the disclosure the first fluid supply 114 includes a pump 200 that draws fuel from a fuel reservoir 202 and discharges the fuel to the first supply conduit 116. The fuel in the fuel reservoir 202 may be a liquid fuel such as diesel fuel, for example.

As schematically shown in FIG. 2, the actuator portion 152 of the injector 100 includes a first control valve 210 operatively coupled to a first actuator 212, and a second control valve 214 operatively coupled to a second actuator 216. The first actuator 212 and the second actuator 216 are both operatively coupled to the controller 140.

The first control valve 210 is in fluid communication with the first control chamber 184 via a first control conduit 218, and in fluid communication with the fuel reservoir 202 via a first fuel return conduit 220. The second control valve 214 is in fluid communication with the second control chamber 190 via a second control conduit 222, and in fluid communication with the fuel reservoir 202 via a second fuel return conduit 224. Accordingly, the controller 140 may effect selective fluid communication between the first control chamber 184 and the fuel reservoir 202 via the first control valve 210, and may effect selective fluid communication between the second control chamber 190 and the fuel reservoir 202 via the second control valve 214.

Operation of the nozzle portion 150 of the injector 100 will now be described. The first fluid supply 114 may apply a substantially constant pressure to the check spring chamber 158 throughout operation of the nozzle portion 150. Alternatively or additionally, the first fluid supply 114 may consistently apply a fluid pressure to the check spring chamber 158 that is greater than or equal to a threshold pressure.

When the first control valve 210 is closed, a leakage path between the check spring chamber 158 and the first control chamber 184 maintains a substantially equal pressure between the check spring chamber 158 and the first control chamber 184. In turn, the bias force from the first check spring 192 urges the distal end 170 of the first check needle 162 into sealing engagement with the internal surface 160 of the body 102, thereby blocking fluid communication between the first fluid supply 114 and the first set of injection orifices 134 via the first injection chamber 154.

When the first control valve 210 is open, fluid from the first control chamber 184 is drained to the fluid reservoir 202 faster than the leakage flow rate from the check spring chamber 158 into the first control chamber 184, thereby dropping the pressure in the first control chamber 184 lower than the pressure in the check spring chamber 158. In turn, the pressure difference between the check spring chamber 158 and the first control chamber 184 biases the first check needle 162 against the force of the first check spring 192 and away from the first injection tip 130, thereby lifting the first check needle 162 and effecting fluid communication between the first fluid supply 114 and the first set of injection orifices 134.

When the second control valve 214 is closed, a leakage path between the check spring chamber 158 and the second control chamber 190 maintains a substantially equal pressure between the check spring chamber 158 and the second control chamber 190. In turn, the bias force from the second check spring 194 urges the distal end 172 of the second check needle 164 into sealing engagement with the internal surface 160 of the body 102, thereby blocking fluid communication between the second fluid supply 118 and the second set of injection orifices 136 via the second injection chamber 156.

When the second control valve 214 is open, fluid from the second control chamber 190 is drained to the fluid reservoir 202 faster than the leakage flow rate from the check spring chamber 158 into the second control chamber 190, thereby dropping the pressure in the second control chamber 190 lower than the pressure in the check spring chamber 158. In turn, the pressure difference between the check spring chamber 158 and the second control chamber 190 biases the second check needle 164 against the force of the second check spring 194 and away from the second injection tip 132, thereby lifting the second check needle 164 and effecting fluid communication between the second fluid supply 118 and the second set of injection orifices 136.

Figure 3:
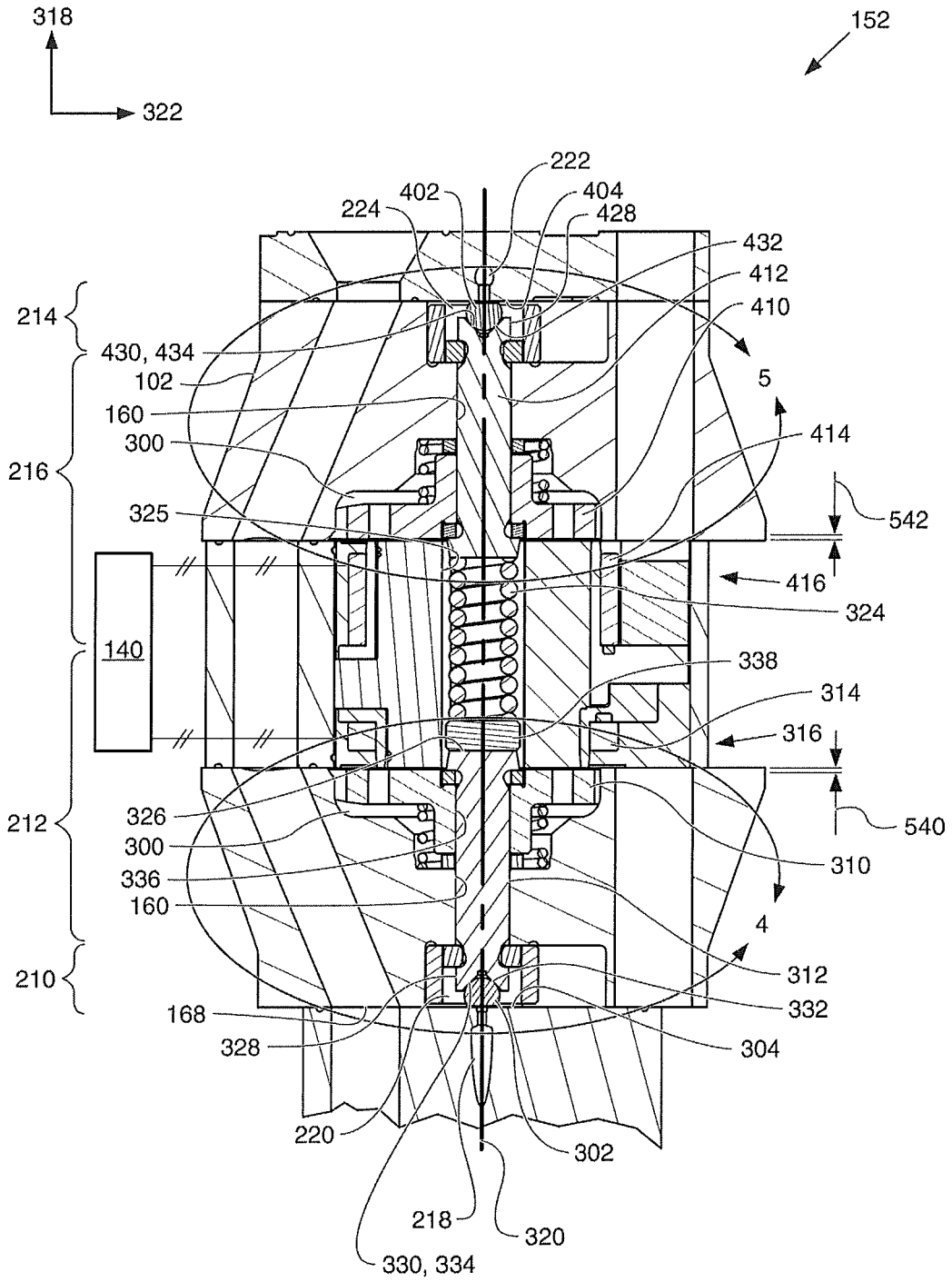
FIG. 3 is a front cross sectional view of an actuator portion of a fluid injector, according to an aspect of the disclosure.

FIG. 3 shows a front cross sectional view of an actuator portion 152 of a fluid injector 100, according to an aspect of the disclosure. The internal surface 160 of the body 102 further defines an actuator cavity 300. The first control valve 210 includes a first control valve element 302 disposed within the actuator cavity 300, and which bears against a first control valve sealing surface 304, thereby blocking fluid communication between the first control conduit 218 and the first fuel return conduit 220.

The first actuator 212 includes a first armature 310, a first stem 312, and a first coil 314 disposed within a first stator 316. The first armature 310 is configured to generate a force along a longitudinal direction 318 toward the first stator 316 in response to a first electromagnetic field generated by the first coil 314. The longitudinal direction 318 extends parallel to a longitudinal axis 320 of the actuator portion 152, and a radial direction 322 extends perpendicular to or normal to the longitudinal direction 318. With respect to descriptions of the actuator portion 152 of the fluid injector 100, the term "proximal" will refer to locations near the stator or directions toward the stator, and "distal" will designate locations or a direction away from the stator, unless specified otherwise.

The first armature 310 is operatively coupled to the first control valve element 302 via the first stem 312. A spring 324 disposed in a spring cavity 325 bears on a proximal end 326 of the first stem 312, thereby biasing the first stem 312 along the longitudinal direction 318 toward the first control valve element 302. The spring 324 may bear on the proximal end 326 of the first stem 312 via direct contact, or via a stem-spring spacer 338 disposed therebetween. A distal end 328 of the first stem 312 may include a concave surface 330 configured to mate with a convex surface 332 of the first control valve element 302. According to an aspect of the disclosure, the concave surface 330 includes a frustoconical surface 334.

Figure 4:
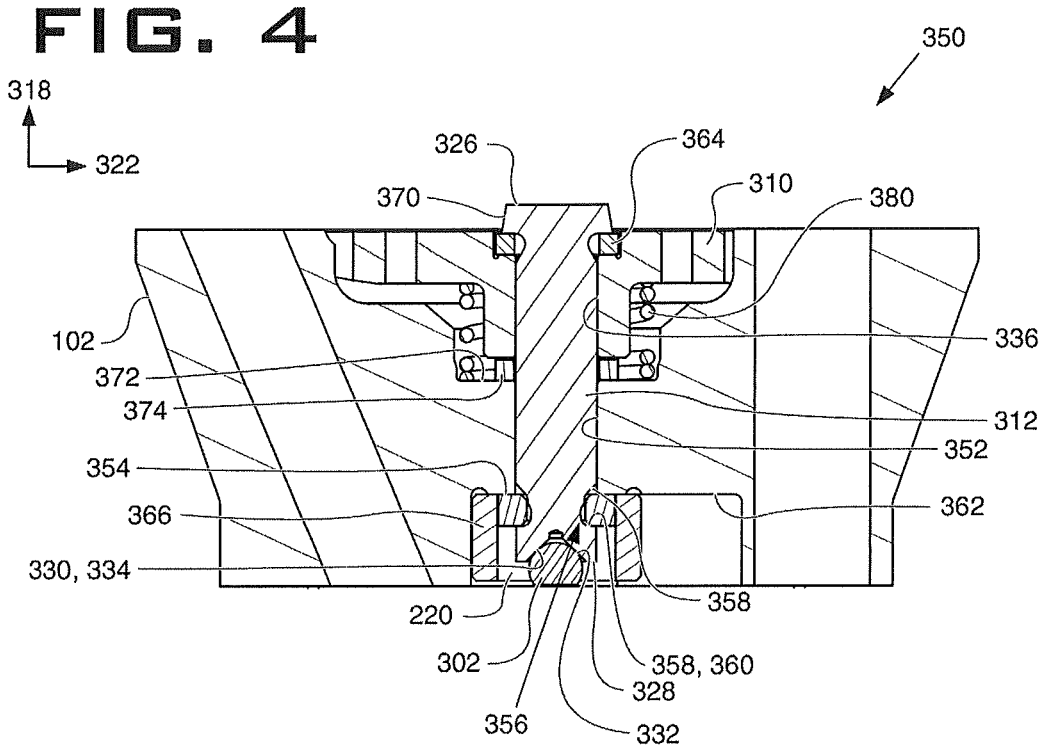
FIG. 4 is a front cross sectional view of an actuator subassembly, according to an aspect of the disclosure.

FIG. 4 shows a front cross sectional view of a first actuator subassembly 350, according to an aspect of the disclosure. The first actuator subassembly 350 may be the subassembly highlighted as Detail 4 in FIG. 3, for example. The first stem 312 is disposed in sliding engagement with a bore 336 through the first armature 310, and in sliding engagement with a first stem guide 352 defined by the internal surface 160 of the body 102. A first valve travel spacer 354 is disposed about a circumferential groove 356 of the first stem 312. The circumferential groove 356 is defined by a first pair of shoulders 358 disposed on the first stem 312, such that the first pair of shoulders 358 at least partly face one another along the longitudinal direction 318.

Although the distal end 328 of the first stem 312, without the first valve travel spacer 354 installed, may be free to translate within the first stem guide 352, installation of the first valve travel spacer 354 on the first stem 312 may effect interference between the first stem 312 and the internal surface 160 of the body 102 via the first valve travel spacer 354 in the longitudinal direction 318. For example a distal shoulder 360 of the first pair of shoulders 358 may bear on the first valve travel spacer 354, and the first valve travel spacer 354 may bear on a first body shoulder 362 defined by the internal surface 160 of the body 102, where the first body shoulder 362 at least partly faces the longitudinal direction 318 toward the distal end 328 of the first stem 312

Accordingly, the first valve travel spacer 354 may effect interference between the first stem 312 and the internal surface 160 of the body 102, such that the first stem 312 will not translate within the first stem guide 352 when the first valve travel spacer 354 is installed on the circumferential groove 356 of the first stem 312. In turn, the first valve travel spacer 354 may limit how far the first stem 312 may translate relative to the body 102 in the longitudinal direction 318 toward the proximal end 326 of the first stem 312. A first annular ring 366 may be disposed about the first valve travel spacer 354, such that the first annular ring 366 is disposed between the first valve travel spacer 354 and the internal surface 160 of the body 102 in the radial direction 322. According to an aspect of the disclosure, the first annular ring 366 also surrounds at least part of the first control valve element 302.

The first stem 312 may include a first stem flange 370 extending in the radial direction 322 from the first stem 312. The first stem flange 370 may interfere with the first armature 310 in the longitudinal direction toward the distal end 328 of the first stem 312, by bearing on a surface of the first armature 310. The first stem flange 370 may bear on the first armature 310 in direct contact, or optionally, via a first stem-armature spacer 364 disposed therebetween. According to an aspect of the disclosure, the first stem flange 370 is disposed at the proximal end 326 of the first stem 312. The first stem-armature spacer 364 may be fabricated from a magnetic or non-magnetic material to tailor the magnetic field imposed on the first armature 310 by the first coil 314. According to an aspect of the disclosure, the first stem-armature spacer 364 is made from a non-magnetic but electrically conductive material, such as, for example, non-magnetic stainless steel.

The first armature 310 may bear on a second body shoulder 372 defined by the internal surface 160 of the body 102. Interference between the first armature 310 and the second body shoulder 372 may limit relative motion therebetween in the longitudinal direction 318. The first armature 310 may bear on the second body shoulder 372 in direct contact, or via a first armature overtravel spacer 374 disposed therebetween. The first armature overtravel spacer 374 may be fabricated from a magnetic or non-magnetic material to tailor the magnetic field imposed on the first armature 310 by the first coil 314. According to an aspect of the disclosure, the first armature overtravel spacer 374 is made from a non-magnetic but electrically conductive material, such as, for example, non-magnetic stainless steel.

The injector 100 may also include a first overtravel spring 380 disposed between the first armature 310 and the internal surface 160 of the body 102, which urges the first armature 310 away from the internal surface 160 of the body 102 in the longitudinal direction 318 toward the proximal end 326 of the first stem 312. According to an aspect of the disclosure, the first overtravel spring 380 bears on the second body shoulder 372.

Returning now to FIG. 3, the second control valve 214 includes a second control valve element 402 disposed within the actuator cavity 300, and which bears against a second control valve sealing surface 404, thereby blocking fluid communication between the second control conduit 222 and the second fuel return conduit 224.

The second actuator 216 includes a second armature 410, a second stem 412, and a second coil 414 disposed within a second stator 416. The second armature 410 is configured to generate a force along a longitudinal direction 318 toward the second stator 416 in response to a second electromagnetic field generated by the second coil 414. It will be appreciated that the first stator 316 and the second stator 416 may both be embodied in a unitary stator assembly, as shown in FIG. 3, or embodied in separate stator assemblies.

The second armature 410 is operatively coupled to the second control valve element 402 via the second stem 412. The spring 324 bears on a proximal end 426 of the second stem 412, thereby biasing the second stem 412 along the longitudinal direction 318 toward the second control valve element 402. A distal end 428 of the second stem 412 may include a concave surface 430 configured to mate with a convex surface 432 of the second control valve element 402. According to an aspect of the disclosure, the concave surface 430 includes a frustoconical surface 434.

Figure 5:
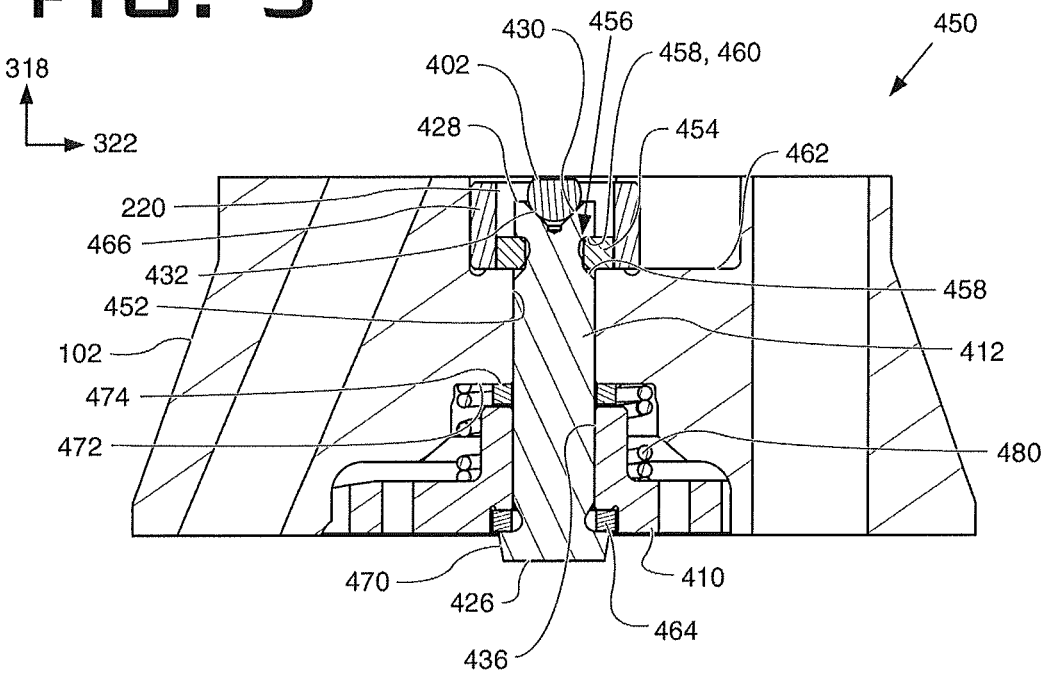
FIG. 5 is a front cross sectional view of an actuator subassembly, according to an aspect of the disclosure.

FIG. 5 shows a front cross sectional view of a second actuator subassembly 450, according to an aspect of the disclosure. The second actuator subassembly 450 may be the subassembly highlighted as Detail 5 in FIG. 3, for example. The second stem 412 is disposed in sliding engagement with a bore 436 through the second armature 410, and in sliding engagement with a second stem guide 452 defined by the internal surface 160 of the body 102. A second valve travel spacer 454 is disposed about a circumferential groove 456 of the second stem 412. The circumferential groove 456 is defined by a second pair of shoulders 458 disposed on the second stem 412, such that the second pair of shoulders 458 at least partly face one another along the longitudinal direction 318.

Although the distal end 428 of the second stem 412, without the second valve travel spacer 454 installed, may be free to translate within the second stein guide 452, installation of the second valve travel spacer 454 on the second stem 412 may effect interference between the second stem 412 and the internal surface 160 of the body 102 via the second valve travel spacer 454 in the longitudinal direction 318. For example a distal shoulder 460 of the second pair of shoulders 458 may bear on the second valve travel spacer 454, and the second valve travel spacer 454 may bear on a third body shoulder 462 defined by the internal surface 160 of the body 102, where the third body shoulder 462 at least partly faces the longitudinal direction 318 toward the distal end 428 of the second stem 412

Accordingly, the second valve travel spacer 454 may effect interference between the second stem 412 and the internal surface 160 of the body 102, such that the second stem 412 will not translate within the second stem guide 452 when the second valve travel spacer 454 is installed on the circumferential groove 456 of the second stem 412. In turn, the second valve travel spacer 454 may limit how far the second stem 412 may translate relative to the body 102 in the longitudinal direction 318 toward the proximal end 426 of the second stem 412. A second annular ring 466 may be disposed about the second valve travel spacer 454, such that the second annular ring 466 is disposed between the second valve travel spacer 454 and the internal surface 160 of the body 102 in the radial direction 322. According to an aspect of the disclosure, the second annular ring 466 also surrounds at least part of the second control valve element 402.

The second stem 412 may include a second stem flange 470 extending in the radial direction 322 from the second stem 412. The second stem flange 470 may interfere with the second armature 410 in the longitudinal direction toward the distal end 428 of the second stem 412, by bearing on a surface of the second armature 410. The second stem flange 470 may bear on the second armature 410 via direct contact, or optionally, via a second stem-armature spacer 464 disposed therebetween. According to an aspect of the disclosure, the second stem flange 470 is disposed at the proximal end 426 of the second stem 412. The second stem-armature spacer 464 may be fabricated from a magnetic or non-magnetic material to tailor the magnetic field imposed on the second armature 410 by the second coil 414. According to an aspect of the disclosure, the second stem-armature spacer 464 is made from a non-magnetic but electrically conductive material, such as, for example, non-magnetic stainless steel.

The second armature 410 may bear on a fourth body shoulder 472 defined by the internal surface 160 of the body 102. Interference between the second armature 410 and the fourth body shoulder 472 may limit relative motion therebetween in the longitudinal direction 318. The second armature 410 may bear on the fourth body shoulder 472 in direct contact, or via a second armature overtravel spacer 474 disposed therebetween. The second armature overtravel spacer 474 may be fabricated from a magnetic or non-magnetic material to tailor the magnetic field imposed on the second armature 410 by the second coil 414. According to an aspect of the disclosure, the second armature overtravel spacer 474 is made from a non-magnetic but electrically conductive material, such as, for example, non-magnetic stainless steel.

The injector 100 may also include a second overtravel spring 480 disposed between the second armature 410 and the internal surface 160 of the body 102, which urges the second armature 410 away from the internal surface 160 of the body 102 in the longitudinal direction 318 toward the proximal end 426 of the second stem 412. According to an aspect of the disclosure, the second overtravel spring 480 bears on the fourth body shoulder 472.

Figure 6:
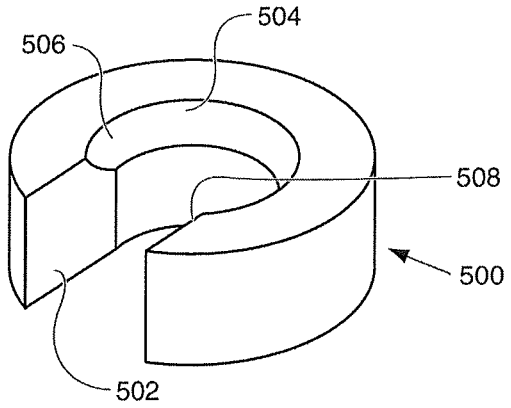
FIG. 6 is a perspective view of a valve travel spacer, according to an aspect of the disclosure.

FIG. 6 shows a perspective view of a valve travel spacer 500, according to an aspect of the disclosure. It will be appreciated that the valve travel spacer 500 could be representative of the first valve travel spacer 354, the second valve travel spacer 454, or both. The valve travel spacer 500 includes two opposing surfaces defining a radial slot 502 extending from a radially internal surface of the valve travel spacer 500 to a radially external surface of the valve travel spacer 500. The valve travel spacer 354 may include a frustoconical surface 504 disposed about a circumference of the radially internal surface from a first retention shoulder 506 to a second retention shoulder 508

Figure 7:
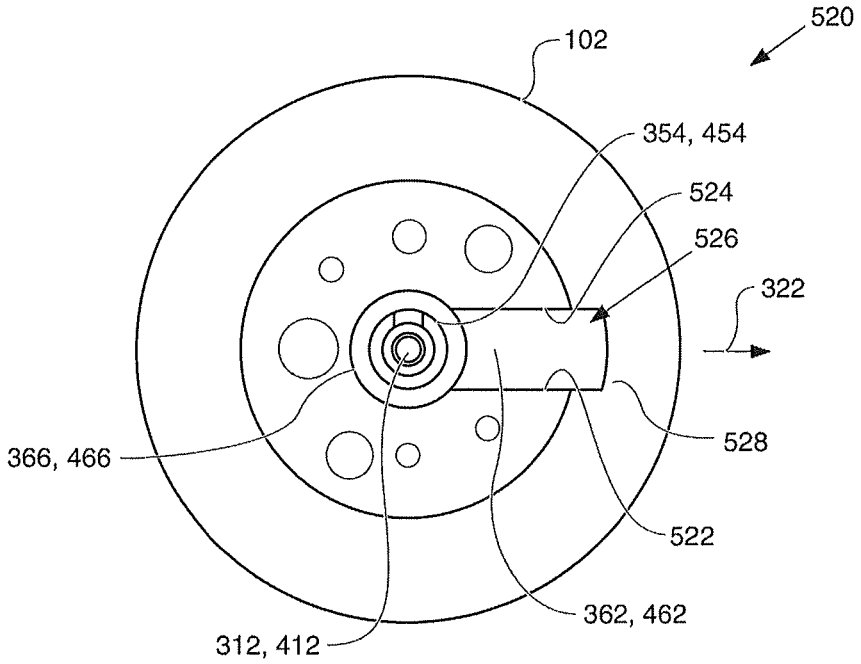
FIG. 7 is an end view of an actuator subassembly, according to an aspect of the disclosure.

FIG. 7 shows an end view of an actuator subassembly 520, according to an aspect of the disclosure. It will be appreciated that the actuator subassembly 520 may be representative of the first actuator subassembly 350, the second actuator subassembly 450, or both. The body 102 includes a pair of surfaces 522, 524 that at least partially face one another, and that define a body channel 526 therebetween. According to an aspect of the disclosure, the body channel 526 extends in the radial direction 322 from the internal surface 160 of the body 102 to an external surface 528 of the body 102. The first body shoulder 362 or the third body shoulder 462 may define at least a part of the floor of the body channel 526, the floor of the body channel 526 extending between the pair of surfaces 522 and 524.

To assemble the first actuator 212, the distal end 328 of the first stem 312 may be inserted through the bore 336 of the first armature 310 and through the first stem guide 352, until the distal end 328 of the first stem 312 projects past the body channel 526. Next, the first valve travel spacer 354 is translated radially along the body channel 526 such that the circumferential groove 356 of the first stem passes through the radial slot 502 of the first valve travel spacer. Then, the first annular ring 366 is translated along the longitudinal direction 318 until it at least partly surrounds the first valve travel spacer 354.

To assemble the second actuator 216, the distal end 428 of the second stem 412 may be inserted through the bore 436 of the second armature 410 and inserted through the second stem guide 452, until the distal end 428 of the second stem 412 projects past the body channel 526. Next, the second valve travel spacer 454 is translated radially along the body channel 526 such that the circumferential groove 456 of the second stem 412 passes into the radial slot 502 of the second valve travel spacer 454. Then, the second annular ring 466 is translated along the longitudinal direction 318 until it at least partially surrounds the second valve travel spacer 454.

INDUSTRIAL APPLICABILITY

The present disclosure is applicable to fluid injectors in general and, more particularly, to fuel injector actuators having a resilient armature overtravel feature. Actuators according to the present disclosure are generally applicable to injecting fuel into an engine for powering a machine.

The machine can be an "over-the-road" vehicle such as a truck used in transportation or may be any other type of machine that performs some type of operation associated with an industry such as mining, construction, farming, transportation, or any other industry known in the art. For example, the machine may be an off-highway truck, earth-moving machine, such as a wheel loader, excavator, dump truck, backhoe, motor grader, material handler or the like. The term "machine" can also refer to stationary equipment like a generator that is driven by an internal combustion engine to generate electricity.

Operation of actuators according to aspects of the present disclosure will now be described with reference to FIGS. 2-5.

The first actuator 212 may default to a first configuration that closes the valve 210 when the first actuator 212 is de-energized by the controller 140. In the first configuration, the spring 324 biases the first stem 312 away from the first stator 316 to seat the first control valve element 302 against the first control valve sealing surface 304, and a gap 540 between the first armature 310 and the first stator 316 assumes a first value. The first value of the gap 540 may be set or adjusted by a thickness of the first stem-armature spacer 364.

The controller 140 may energize the first actuator 212, at least in part by directing an electric current to the first coil 314, which in turn applies a magnetic field to the first armature 310. In response to the magnetic field, the first armature 310 experiences a force drawing the first armature 310 toward the first stator 316 along the longitudinal direction 318, resulting in a decrease in the gap 540 between the first armature 310 and the first stator 316. The first stem 312 is also drawn toward the first stator 316 by the motion of the first armature 310, through interference between the first stem flange 370 and the first armature 310 along the longitudinal direction 318. According to an aspect of the disclosure, the first armature 310 and the first stem 312 translate together in unison relative to the body 102 when the actuator 212 is energized.

Further, as a result of energizing the first actuator 212, the first control valve element 302 is free to translate away from the first control valve sealing surface 304, thereby effecting fluid communication between the first control conduit 218 and the first fuel return conduit 220, as described previously. The travel of the first stem 312 in response to energizing the first actuator 212 may be limited by interference between the first stem 312 and the first body shoulder 362 via the first valve travel spacer 354.

When the controller 140 next de-energizes the first actuator 212 by stopping electric current flow through the first coil 314, the spring 324 urges both the first stem 312 and the first armature 310 away from the first stator 316 in the longitudinal direction 318 until the distal end 328 of the first stem 312 seats the first control valve element 302 against the first control valve sealing surface 304. However, even after relative motion between the first stem 312 and the body 102 ends, the inertia of the first armature 310 may cause the first armature 310 to overtravel, or to continue translating relative to both the first stem 312 and the body 102 along the longitudinal direction 318 away from the first stator 316. The first overtravel spring 380 resists overtravel movement of the first armature 310 away from the first stator 316, and therefore urges the first armature 310 back to its first configuration, such that the gap 540 may eventually resume its first equilibrium value.

The second actuator 216 may default to a first configuration that closes the valve 214 when the second actuator 216 is de-energized by the controller 140. In the first configuration, the spring 324 biases the second stem 412 away from the second stator 416 to seat the second control valve element 402 against the second control valve sealing surface 404, and a gap 542 between the second armature 410 and the second stator 416 assumes a first value. The first value of the gap 542 may be set or adjusted by a thickness of the second stem-armature spacer 464.

The controller 140 may energize the second actuator 216, at least in part by directing an electric current to the second coil 414, which in turn applies a magnetic field to the second armature 410. In response to the magnetic field, the second armature 410 experiences a force drawing the second armature 410 toward the second stator 416 along the longitudinal direction 318, resulting in a decrease in the gap 542 between the second armature 410 and the second stator 416. The second stem 412 is also drawn toward the second stator 416 by the motion of the second armature 410, through interference between the second stem flange 470 and the second armature 410 along the longitudinal direction 318. According to an aspect of the disclosure, the second armature 410 and the second stem 412 translate together in unison relative to the body 102 when the actuator 216 is energized.

Further, as a result of energizing the second actuator 216, the second control valve element 402 is free to translate away from the second control valve sealing surface 404, thereby effecting fluid communication between the second control conduit 222 and the second fuel return conduit 224, as described previously. The travel of the second stem 412 in response to energizing the second actuator 216 may be limited by interference between the second stem 412 and the third body shoulder 462 via the second valve travel spacer 454.

When the controller 140 next de-energizes the second actuator 216 by stopping electric current flow through the second coil 414, the spring 324 urges both the second stem 412 and the second armature 410 away from the second stator 416 in the longitudinal direction 318 until the distal end 428 of the second stem 412 seats the second control valve element 402 against the second control valve sealing surface 404. However, even after relative motion between the second stem 412 and the body 102 ends, the inertia of the second armature 410 may cause the second armature 410 to overtravel, or to continue translating relative to both the second stem 412 and the body 102 along the longitudinal direction 318, away from the second stator 416. The second overtravel spring 480 resists overtravel movement of the second armature 410 away from the second stator 416, and therefore urges the second armature 410 back to its first configuration, such that the gap 542 may eventually resume its first equilibrium value.

Aspects of the present disclosure offer advantages over conventional approaches. According to an aspect of the disclosure, employing a unitary stator with two independently actuated coils 314, 414; employing a shared spring 324 bearing against proximal ends of two separate armature stems 312, 412; or both, may reduce complexity, part count, and cost of a dual-actuator assembly. According to another aspect of the disclosure, the structure allows the armature 310, 410 to overtravel relative to the corresponding armature stem 312, 412 upon de-energizing a corresponding coil 314, 414, and provides an overtravel spring 380, 480 to resist overtravel magnitude, in an assembly having a single-piece armature stem 312, 412 that bears directly on a corresponding control valve element 302, 402, thereby providing overtravel means with a simple structure having a low part count.

According to another aspect of the disclosure, employing a valve travel spacer 354, 454 about a circumferential groove 356, 456 disposed near a distal end of an actuator stem may facilitate actuator assembly by allowing the distal end 328, 428 of an armature stem 312, 412 to be inserted through the armature 310, 410 and body 102 in the longitudinal direction 318 from the stator 316, 416 toward the corresponding control valve element 302, 402. Such a valve travel spacer 354, 454 arrangement with the armature stem 312, 412 may facilitate assembly, tolerance control, and operation of a dual-actuator fluid injector 100.

Aspects of the disclosure provide a method for actuating a fuel injector, the fuel injector including a stem disposed within a body and operatively coupled to an armature and a valve, the stem including a first stem shoulder at least partly facing a second stem shoulder, the first stem shoulder and the second stem shoulder defining a circumferential groove therebetween, and a valve travel spacer disposed about the circumferential groove, the method comprising: energizing a solenoid to translate the armature away from the valve along a longitudinal direction of the stem until the first stem shoulder bears on the valve travel spacer and the valve travel spacer bears on the body; and de-energizing the solenoid to translate the stem toward the valve along the longitudinal direction of the stem until the valve travel spacer bears on the second stem shoulder.

According to another aspect of the disclosure, the method for actuating a fuel injector further comprises urging the stem toward the valve along the longitudinal direction of the stem via a spring bearing on the stem.

According to another aspect of the disclosure, the method for actuating a fuel injector further comprises translating the armature relative to the stem and toward the valve.

According to another aspect of the disclosure, the method for actuating a fuel injector further comprises translating the armature relative to the stem and toward the valve until the armature bears on an overtravel spacer and the overtravel spacer bears on the body.

According to another aspect of the disclosure, the method for actuating a fuel injector further comprises translating the armature relative to the stem and away from the valve until the armature bears on a radial flange of the stem.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. An actuator for a valve assembly, the actuator comprising:

a body having an internal surface defining a bore therein, the internal surface including a first body shoulder at least partly facing a longitudinal direction defined along a longitudinal axis of the bore;

a first armature disposed within the bore, the first armature being configured to generate a force in response to a first electromagnetic field acting thereon;

a first stem operatively coupled to the first armature and a first valve of the valve assembly;

a first pair of shoulders disposed on the first stem, the first pair of shoulders at least partly facing one another and defining a first stem circumferential groove therebetween; and a first valve travel spacer disposed about the first stem circumferential groove, and disposed in interference with the first body shoulder along the longitudinal direction.

2. The actuator of claim 1, wherein the first valve travel spacer is in interference with the first stem along the longitudinal direction via the first pair of shoulders.

3. The actuator of claim 1, further comprising a first spring bearing on a proximal end of the first stem, thereby biasing the first stem toward the first valve along the longitudinal direction.

4. The actuator of claim 1, further comprising a first annular ring disposed between the first valve travel spacer and the internal surface of the body along a radial direction, the radial direction being normal to the longitudinal direction.

5. The actuator of claim 1, wherein the internal surface of the body further includes a first pair of surfaces at least partly facing one another, the first pair of surfaces and the first body shoulder at least partly defining a first body channel, the first body channel being configured to receive the first valve travel spacer in sliding engagement at least partly along a radial direction that is normal to the longitudinal direction.

6. The actuator of claim 1, further comprising a second spring disposed between the first armature and the internal surface of the body along the longitudinal direction, thereby biasing the first armature away from the first valve along the longitudinal direction.

7. The actuator of claim 6, further comprising a first overtravel spacer disposed between the first armature and the internal surface of the body, the first overtravel spacer being disposed between the first armature and the first valve along the longitudinal direction.

8. The actuator of claim 7, wherein a material of the first overtravel spacer is non-magnetic.

9. The actuator of claim 3, wherein the first stem includes a first stem flange extending at least partly in a radial direction and disposed between the first armature and the proximal end of the first stem, the first stem flange being in interference with the first armature along the longitudinal direction, the radial direction being normal to the longitudinal direction.

10. The actuator of claim 9, further comprising a stem-armature spacer disposed between the first stem flange and the first armature along the longitudinal direction.

11. The actuator of claim 1, wherein the internal surface of the body further includes a second body shoulder at least partly facing away from the first body shoulder, the actuator further comprising:

a second armature disposed within the bore, the second armature being configured to generate a force in response to a second electromagnetic field acting thereon;

a second stem operatively coupled to the second armature and a second valve of the valve assembly;

a second pair of shoulders disposed on the second stem, the second pair of shoulders at least partly facing one another and defining a second stem circumferential groove therebetween; and a second valve travel spacer disposed about the second stem circumferential groove in interference with the second body shoulder along the longitudinal direction.

12. The actuator of claim 11, wherein the second valve travel spacer is in interference with the second stem along the longitudinal direction via the second pair of shoulders.

13. The actuator of claim 11, further comprising a first spring bearing on the first stem and the second stem, thereby biasing the first stem toward the first valve along the longitudinal direction and biasing the second stem toward the second valve along the longitudinal direction.

14. The actuator of claim 13, further comprising a spring spacer bearing on the first spring, the first spring spacer being disposed between the first stem and the second stem along the longitudinal direction.

15. The actuator of claim 11, further comprising a stator disposed between the first armature and the second armature along the longitudinal direction, the stator including a first coil configured to apply the first electromagnetic field to the first armature and a second coil configured to apply the second electromagnetic field to the second armature.

16. A fuel injector, comprising:

a valve assembly;

a body having an internal surface defining a bore therein, the internal surface including a first body shoulder at least partly facing a longitudinal direction defined along a longitudinal axis of the bore;

a first armature disposed within the bore, the first armature being configured to generate a force in response to a first electromagnetic field acting thereon;

a first stem operatively coupled to the first armature and a first valve of the valve assembly;

a first pair of shoulders disposed on the first stem, the first pair of shoulders at least partly facing one another and defining a first stem circumferential groove therebetween; and a first valve travel spacer disposed about the first stem circumferential groove in interference with the first body shoulder along the longitudinal direction.

17. The fuel injector of claim 16, further comprising a check valve configured to effect selective fluid communication between a pressurized fuel supply and at least one injection orifice, the first valve being configured to effect selective fluid communication between the check valve and a fuel reservoir.

18. A method for assembling an actuator for a valve, comprising:

inserting a distal end of a stem through a bore of an armature;

inserting the distal end of the stem through a bore of an actuator body;

translating a valve travel spacer along a radial channel of the actuator body until the valve travel spacer engages a circumferential groove of the stem, thereby disposing the valve travel spacer between the distal end of the stem and the actuator body along a longitudinal axis of the stem; and translating an annular ring along the longitudinal axis of the stem until the annular ring is disposed between the valve travel spacer and the actuator body along a radial direction, the radial direction being normal to the longitudinal axis of the stem.

19. The method of claim 18, further comprising:

inserting the distal end of the stem through a bore of an overtravel spacer, thereby locating the overtravel spacer between the armature and the actuator body along the longitudinal axis of the stem; and inserting the distal end of the stem through an overtravel spring, thereby locating the overtravel spring between the armature and the actuator body along the longitudinal axis of the stem.

* * * * *